United States Patent [19]

Fell

[11] Patent Number: 4,999,854

[45] Date of Patent: Mar. 19, 1991

[54] PANTY HOSE GARMENT WITH INNER-THIGH PANELS

[76] Inventor: Donna L. Fell, 8-A Auburn Ct., Alexandria, Va. 22305

[21] Appl. No.: 388,711

[22] Filed: Aug. 2, 1989

Related U.S. Application Data

[63] Continuation of Ser. No. 149,675, Jan. 28, 1988, abandoned.

[51] Int. Cl.[5] ..... A41B 11/00; A41B 11/02

[52] U.S. Cl. ..... 2/409; 450/104; 450/142

[58] Field of Search ..... 2/409, 407, 404, 78 B, 2/78 C, 78 R, 227; 450/102, 103, 104, 142; 66/178 R

[56] References Cited

U.S. PATENT DOCUMENTS

| | | | |
|---|---|---|---|
| 557,563 | 4/1896 | Dunning | 2/401 |
| 1,277,074 | 8/1918 | Hitzman | 2/78 C |
| 1,587,576 | 6/1926 | Beck | 2/407 X |
| 1,616,688 | 2/1927 | Gershenow | 2/401 |
| 1,629,147 | 5/1927 | Chatfield | 2/401 |
| 2,093,371 | 9/1937 | Sheehy | 2/407 |
| 2,190,425 | 2/1904 | Hurd | 2/78 B X |
| 2,293,346 | 8/1942 | Laskin | 2/407 |
| 2,318,199 | 5/1943 | Clements | 2/407 |
| 2,381,816 | 8/1945 | Frieman | 2/224 |
| 2,651,047 | 9/1953 | Emerson | 2/78 B |
| 2,719,976 | 10/1955 | Sussman | 2/43 |
| 3,392,733 | 7/1968 | Blair | 450/104 |
| 3,548,834 | 12/1970 | Geimer | 450/104 |
| 3,757,354 | 9/1973 | Moody | 2/409 |
| 4,267,607 | 5/1981 | Tino | 2/409 |
| 4,351,068 | 9/1982 | Taylor | 2/409 |
| 4,400,832 | 8/1983 | Kinder | 2/409 X |

FOREIGN PATENT DOCUMENTS

| | | | |
|---|---|---|---|
| 825532 | 12/1951 | Fed. Rep. of Germany | 2/406 |
| 1191122 | 4/1959 | France | 2/409 |

*Primary Examiner*—Werner H. Schroeder
*Assistant Examiner*—Jeanette E. Chapman
*Attorney, Agent, or Firm*—Donna Lee Fell

[57] ABSTRACT

A panty hose garment constructed with woven, friction reducing inner-thigh panels and knitted pant and leg portions; the leg portions extending below the knees of the wearer. The inner-thigh panels are of a woven fabric and the panels face or line the inner-thigh regions of the leg portions. The construction and position of these panels will prevent the skin of the wearer from coming through the knitted fabric and will shield the skin of each inner thigh of a wearer from rubbing against the knitted leg portion of the other leg of the garment or against the skin of the other thigh of the wearer. These panels extend downward along the inner thigh from the crotch of the garment part way down the leg portions at least one-half the distance from the crotch to the knee.

2 Claims, 1 Drawing Sheet

PANTY HOSE GARMENT WITH INNER-THIGH PANELS

This application is a continuation of application Ser. No. 07/149,675, filed Jan. 28, 1988.

BACKGROUND OF THE INVENTION

1. Field of the Invention.

The present invention is a novel panty hose garment with special panels fashioned on the inner thighs to reduce friction, wear and chafing.

2. Description of the Prior Art.

The body garment described as "panty hose" is one of the most widely available articles of clothing on the retail market today. Most such panty hose are manufactured for use by women and are considered fashion accessories—an article of clothing to coordinate with and complement other articles of attire.

It should be noted that panty hose are functional as well as fashionable in that they are worn for warmth and for support.

However, even those that are designed for function strive to meet exacting criteria for appearance which dictates the use of light denier fibers and loose or open knits.

Such open knits fabrics are subject to excessive wear when the fabric comes into repeated contact with itself or other surfaces. This wearing condition is experienced by many women whose inner thighs brush together while walking. Under such conditions the open knit of the fabric stretches even further permitting the skin of the inner thighs to rub together and chafe. The fibers themselves also wear through very readily resulting in holes in the fabric. The holes quickly develop into runs and thereby shorten the useful life of the garment.

It is an object of the present invention to provide a low-friction surface on the inner thigh region of the panty hose resulting not only in improved wearing characteristics of the garment but also in enhanced comfort as well.

SUMMARY OF THE INVENTION

The present invention is a modification of a conventional panty hose garment wherein the customary fine denier, loose knit stocking fabric is fashioned with opposing inner-thigh panels of heavier grade, woven cotton fabric. The purpose of the inner-thigh panels is to reduce the annoying friction, and thereby reduce chafing and wear as well, that frequently occurs on the inner thighs of the wearer of panty hose. The cotton panels are integrally connected to the unitary construction of the panty hose garment such that any contact between the thighs of the wearer occurs on the surfaces of the soft cotton panels.

BRIEF DESCRIPTION OF THE DRAWINGS

The invention may be further understood by reference to the drawings in which.

DESCRIPTION OF THE PREFERRED EMBODIMENT

Figure 1:
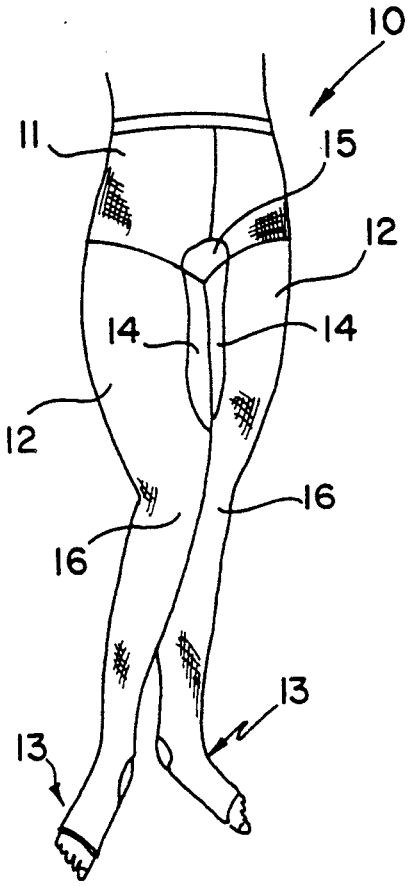
FIG. 1 is a front view of the panty hose garment with inner-thigh panels.
Figure 2:
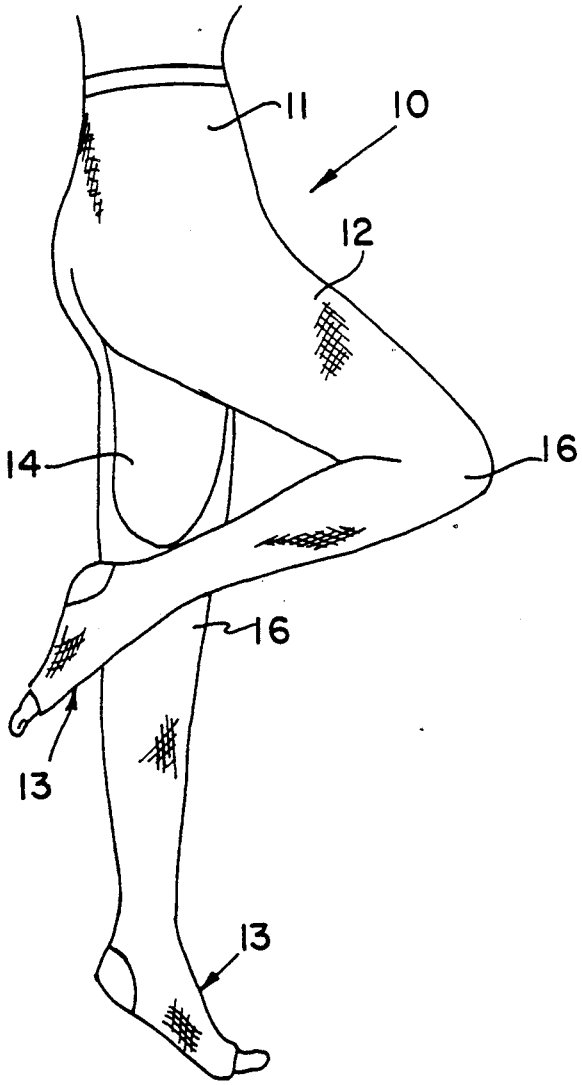
FIG. 2 is a side view of the panty hose garment with inner-thigh panels.

Referring to FIGS. 1 and 2 of the drawings, one configuration of the invention can be seen wherein a conventional panty hose garment 10 comprising a pants portion 11, integrally connected leg portions 12 and integrally connected foot portions 13 is further fashioned with integrally connected inner-thigh panels 14 which preferably connect with and span the crotch 15 of the said garment. Said inner-thigh panels 14 also preferably extend downward on the inner-thigh region approximately one half to three quarters of the distance between the crotch 15 and the knee 16.

Said inner-thigh panels 14 are preferably fabricated from woven cotton material although fabrics woven from other natural and man-made fibers may be equally suitable for the described objects of this invention.

Utilization of the present invention does not, of course, require that the panty hose article have foot portions or any other features aside from the pant and stocking leg of the garment.

I claim:

1. A panty hose garment comprising:

knit pant and leg portions, said leg portions extending below the knee of a wearer; said garment being provided with woven fabric panels facing inner-thigh regions of said leg portions for shielding the skin of each inner-thigh of a wearer from rubbing against the leg portion of the other leg of the garment or against the skin of the other thigh of the wearer, said panels extending downward along the inner thigh from the crotch of the garment partway down the leg portions at least one-half the distance from the crotch to the knee of said garment.

2. A panty hose garment as recited in claim 1 wherein said woven fabric panels extend from the crotch of said garment downward on the inner-thigh region approximately one half to three quarters of the distance from said crotch to the knee of said garment.

* * * * *